US007392069B2

(12) United States Patent
Gartrell et al.

(10) Patent No.: US 7,392,069 B2
(45) Date of Patent: Jun. 24, 2008

(54) HANDLE FOR A MOBILE STATION AND METHOD OF USING THE SAME

(75) Inventors: Andrew Julian Gartrell, Tarzana, CA (US); Steven Arthur Shaw, Plano, TX (US)

(73) Assignee: Nokia Corporation, Espoo (FI)

( * ) Notice: Subject to any disclaimer, the term of this patent is extended or adjusted under 35 U.S.C. 154(b) by 761 days.

(21) Appl. No.: 10/782,317

(22) Filed: Feb. 19, 2004

(65) Prior Publication Data

US 2005/0183242 A1 Aug. 25, 2005

(51) Int. Cl.
*H04M 1/00* (2006.01)

(52) U.S. Cl. ..... 455/575.1; 455/90.3; 455/128; 455/129

(58) Field of Classification Search ..... 455/128, 455/575.1, 575.7, 575.8, 95, 100, 90.3, 129, 455/127.1; 343/787
See application file for complete search history.

(56) References Cited

U.S. PATENT DOCUMENTS

| | | | | |
|---|---|---|---|---|
| 4,717,229 | A * | 1/1988 | Cutler | 385/31 |
| 5,938,137 | A | 8/1999 | Poulson | |
| 6,155,841 | A | 12/2000 | Spanyar | |
| 6,188,362 | B1 * | 2/2001 | Igarashi | 343/702 |
| 6,535,605 | B1 * | 3/2003 | Ghassabian | 379/433.1 |
| 6,642,837 | B1 | 11/2003 | Vigoda et al. | |
| 2003/0010859 | A1 | 1/2003 | Ryczek | |
| 2003/0042348 | A1 | 3/2003 | Salentine et al. | |
| 2004/0204204 | A1 * | 10/2004 | Brilliant et al. | 455/575.1 |
| 2005/0113036 | A1 * | 5/2005 | Lita | 455/90.3 |

FOREIGN PATENT DOCUMENTS

| | | |
|---|---|---|
| EP | 0 993 068 | 4/2000 |
| JP | 2003079408 | 3/2003 |
| WO | WO 01/22526 | 3/2001 |
| WO | WO 01/22526 A1 * | 3/2001 |

OTHER PUBLICATIONS

PCT Notification of Transmittal of the International Search Report, PCT International Search Report mailed Jul. 4, 2005 for PCT/IB2005/000365 (Filed Feb. 14, 2005).

* cited by examiner

*Primary Examiner*—Tan Trinh
(74) *Attorney, Agent, or Firm*—Alston & Bird LLP

(57) ABSTRACT

A bangle or handle for supporting a mobile station that includes a continuous loop of resiliently compressible material. A portion of the length of the handle is configured to fit within a channel defined in a housing of the mobile station. A second length portion extends from the housing to form a loop of the handle that can be gripped by the user, or otherwise used to suspend the mobile station. The handle may also include a conducting element that extends through the loop and is in communication with a conducting contact of the loop. The conducting contact of the continuous loop can be positioned in overlying contact with a conducting contact of the housing of the mobile station. Such contact supplies power or signals to, and receives power or signals from, a device such as a light, fan, noise generator or camera, connected to the second length portion.

27 Claims, 9 Drawing Sheets

HANDLE FOR A MOBILE STATION AND METHOD OF USING THE SAME

BACKGROUND

1. Field of the Invention

The present invention is related to the field of mobile stations, and more particularly to the field of tethers, handles and other accessories that facilitate transport of mobile stations.

2. Description of Related Art

Participants in the mobile telephone industry are in a constant search to differentiate their telephones by making them easier to use and more aesthetically appealing. For example, accessories have been developed for mobile telephones that facilitate their handling by providing tethers, lanyards or handles. In one instance, a tether includes a length of cord defining a loop and having a fastener on one end extending between and attaching the loop and a housing of the mobile telephone. In this manner, a user of the mobile telephone can extend their fingers, or even entire hand, through the loop so that the mobile telephone dangles from their fingers or wrist.

Tethers, handles and lanyards can have additional functions beyond facilitating handling of the mobile telephone. For instance, PCT publication WO 01/22526 to Ritter ("Ritter") discloses a mobile telephone with a yoke antenna. In particular, as shown in FIG. 1 of Ritter, the telephone includes a housing 10 and a yoke 25 consisting of two metal wires 21, 22 and a non-conductive connecting portion 23. The yoke has ends that attach to corners 17, 18 of the housing so as to form a loop. In addition to being able to support the rest of the mobile station, the metal wires serve as separate transmitting or receiving antennas.

Despite the advantages of the above-listed devices, further improvements in the aesthetic appearance, ease of use and transportability of mobile stations are always desirable. Therefore, it would be advantageous to have a handle for a mobile station that facilitates handling of the mobile station while at the same time providing additional useful functions.

SUMMARY

The present invention addresses the above needs and achieves other advantages by providing a bangle or handle for supporting a mobile station. The handle includes a continuous loop of preferably resiliently compressible material for grasping, hanging and manipulation. A portion of the length of the handle is configured to fit within a channel defined in a housing of the mobile station. A second length portion extends from the housing to form a loop of the handle that can be gripped by the user, or otherwise used to suspend the mobile station. The handle may also include a conducting element that extends through the loop and is in communication with a conducting contact of the loop. The conducting contact of the continuous loop can be positioned in overlying contact with a conducting contact of the housing of the mobile station. Such contact supplies power or signals to, and receives power or signals from, a device such as a light, fan, noise generator or camera, connected to the second length portion.

In one embodiment, the present invention includes a mobile station with a telecommunications assembly, a power source, a housing and a continuous loop of resiliently compressible material. The telecommunications assembly is capable of receiving and generating wireless telecommunication signals. The power source, such as a battery, is capable of supplying power to the telecommunications assembly. Containing at least a portion of the telecommunications assembly is the housing which also defines a channel for receiving the continuous loop of resiliently compressible material. The continuous loop of resiliently compressible material includes a first length portion that is generally equal to a length of the channel defined by the housing. A cross-section of the first length portion is configured to be press fit into the channel so that a second length portion extends out of the housing. Advantageously, the housing, and the rest of the mobile station, may be suspended from the second length portion.

In another aspect, the first length portion is configured to be press fit into the channel and includes at least one conducting contact. The conducting contact of the first length portion is positioned so as to overlie a conducting contact of the housing which is connected in communication with the power source.

The mobile station can also include a conducting element (e.g., wire, fiber optic filament or flexible printed circuit) that extends along the continuous loop of material and that is in conducting communication with the conducting contact of the first length portion. The conducting contact of the first length portion may be constructed of a conductive elastomeric material that is configured to extend between the conducting contact of the housing and the conducting element. In another aspect, the conductive elastomeric material forms several spaced bands or contact portions that alternate with nonconductive material bands or contact portions of the first length portion to form a zebra-type conducting contact.

In another aspect, the mobile station may include one or more electrically or optically operated devices for connection to the second length portion of the continuous loop of the handle. For this purpose, the mobile station may also include a connecting element connected to the conducting element and capable of receiving one of the devices. As an example, the connecting element can be a circular collet defining an opening which is sized to receive the device and is spring-biased to retain the device. Examples of the devices include a light, a fan, a noise generator or a camera.

In yet another aspect, the housing of the mobile station can include a cover which extends over the channel and helps to hold the first length of the continuous loop of material in the channel.

The mobile station and handle of the present invention have many advantages. For instance, the handle can be used to support the mobile station from a wrist, wall-mounted peg, stand, clothes, etc., and is easily exchangeable with other handles having alternative aesthetic properties for customization of the mobile station. When not attached to the mobile station, the different types of handle can be worn as bracelets or jewelry due to their inherent flexibility and the continuous construction of the loop material. The functionality of the mobile station is also improved by the use of the various optical/electronic devices, such as the camera. Therefore, the interchangeability of the devices also allows functional, as well as the aforementioned aesthetic, customization. The conducting contact which uses the alternating contact portions of conducting elastomeric material allows the entire continuous loop of material to be flexible.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

A mobile station 10 of one embodiment of the present invention includes a telecommunications assembly 11, a housing 12 and a handle 13, as shown in the accompanying Figures. Generally, the housing 12 contains the telecommunications assembly 11 and serves as a connection point for the handle 13 so that the handle can support the rest of the mobile station, such as from a user's wrist. It should be understood, that the mobile telephone illustrated and hereinafter described is merely illustrative of one type of mobile station that would benefit from the present invention and, therefore, should not be taken to limit the scope of the present invention.

For example, other types of mobile stations, such as portable digital assistants (PDAs), pagers, laptop computers and other types of voice and text communications systems, can readily employ the present invention. Moreover, the system and method of the present invention will be primarily described in conjunction with mobile communications applications. But the system and method of the present invention can be utilized in conjunction with a variety of other applications, both in the mobile communications industries and outside of the mobile communications industries.

Generally, the housing 12 supports a display, keys and other conventionally known components (battery, microphone, processor, etc.) necessary for the mobile station to receive, process and generate wireless communications signals. Collectively, these components are referred to herein as the wireless telecommunications assembly which, being known to those of skill in the art, are not described in greater detail herein.

Figure 1:
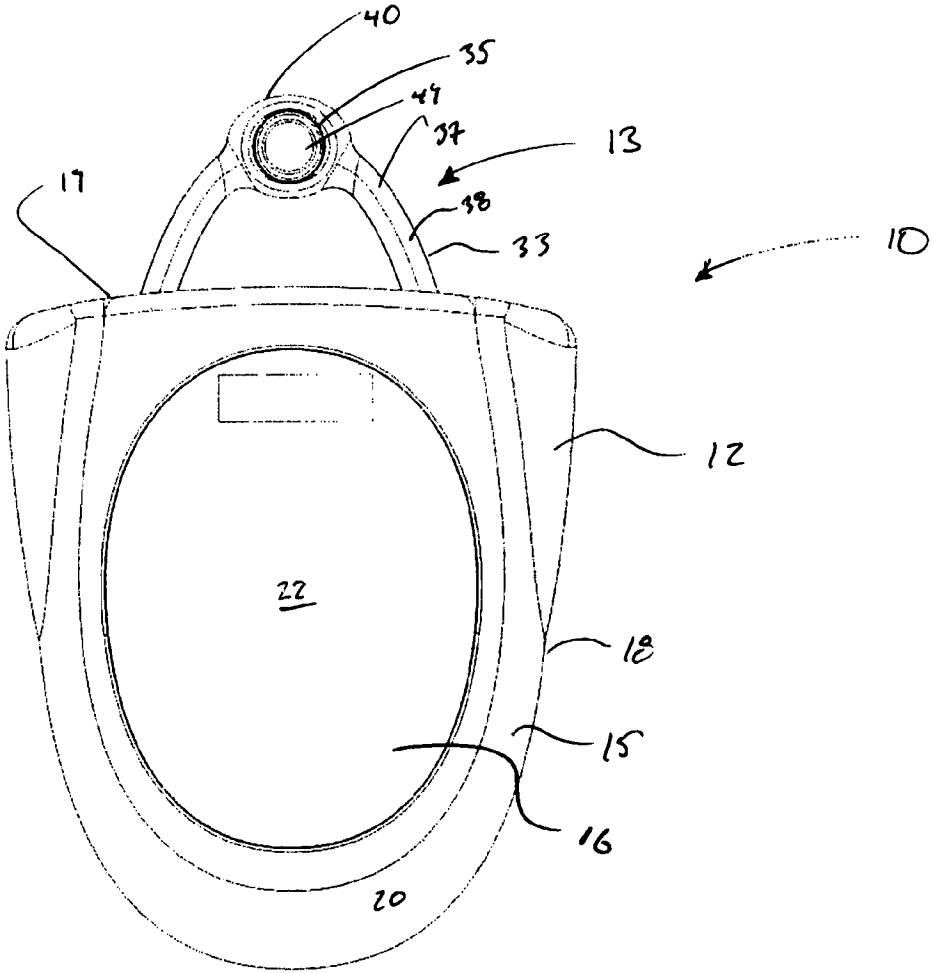
FIG. 1 is a front elevation view of a mobile station and handle of one embodiment of the present invention.
Figure 2:
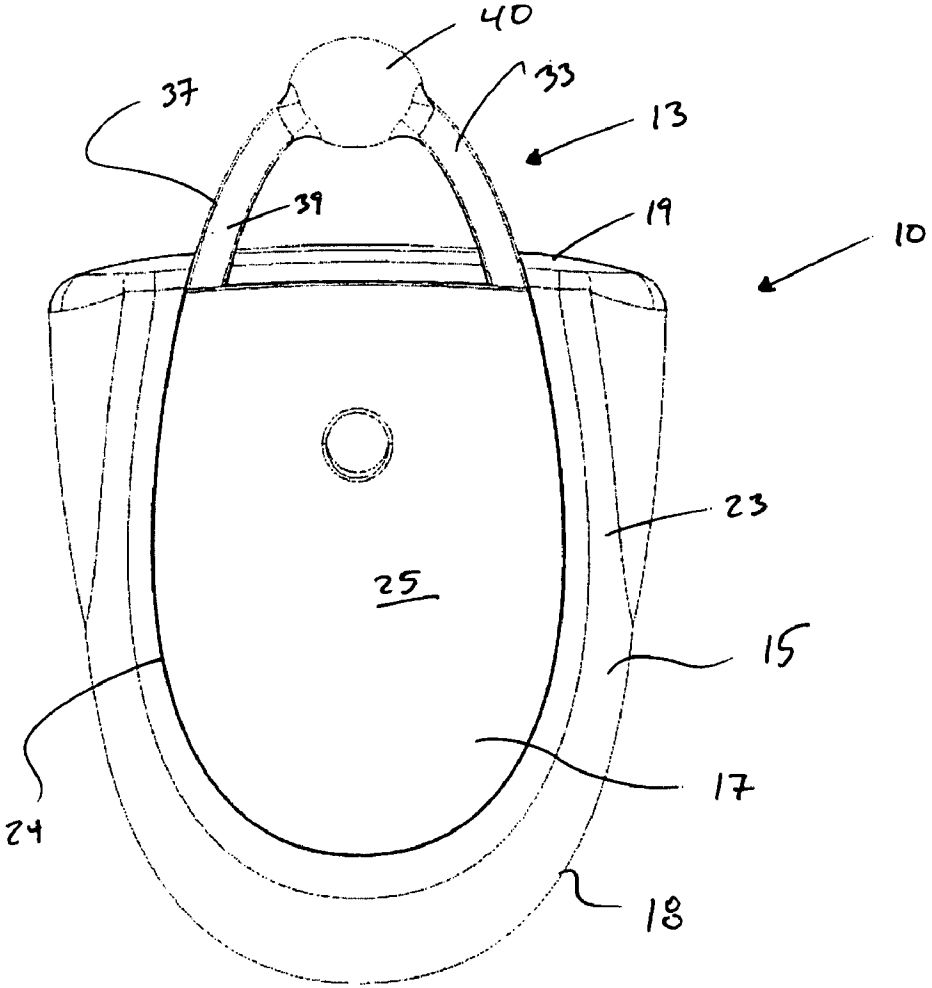
FIG. 2 is rear elevation view of the mobile station and handle of FIG. 1.

One embodiment of a suitable mobile station 10 is described below and shown in FIGS. 1 and 2. It should be understood, however, that the mobile station may have a wide variety of other shapes and form factors while still incorporating embodiments of the present invention. In the illustrated embodiment of FIGS. 1 and 2, the housing 12 includes a main body 15, a keypad cover 16 and a battery cover 17. The main body 15 contains the majority of the telecommunications assembly 11 and generally has a U-shape with rounded peripheral edges 18 that extend downwards from a mostly flat top peripheral edge 19. Extending between the peripheral edges 18, 19 are opposing first and second faces 20 and 23, respectively.

The first face 20 of the illustrated embodiment includes an inner edge 21 which defines a U-shaped recess so that the keypad cover, which itself has a U-shape, can be positioned within the recess. As a result, the inner edge of the first face 20 surrounds and abuts the edges of the keypad cover 16 so that an outer surface 22 of the keypad cover is flush with the first face. The second face 23 similarly has its own inner edge 24 which defines a U-shaped recess so that the battery cover 17, which itself has a U-shape, can be positioned within the recess. In this manner, the second face 23 is flush with an outer surface 25 of the battery cover 17, as shown in FIG. 2.

Figure 3:
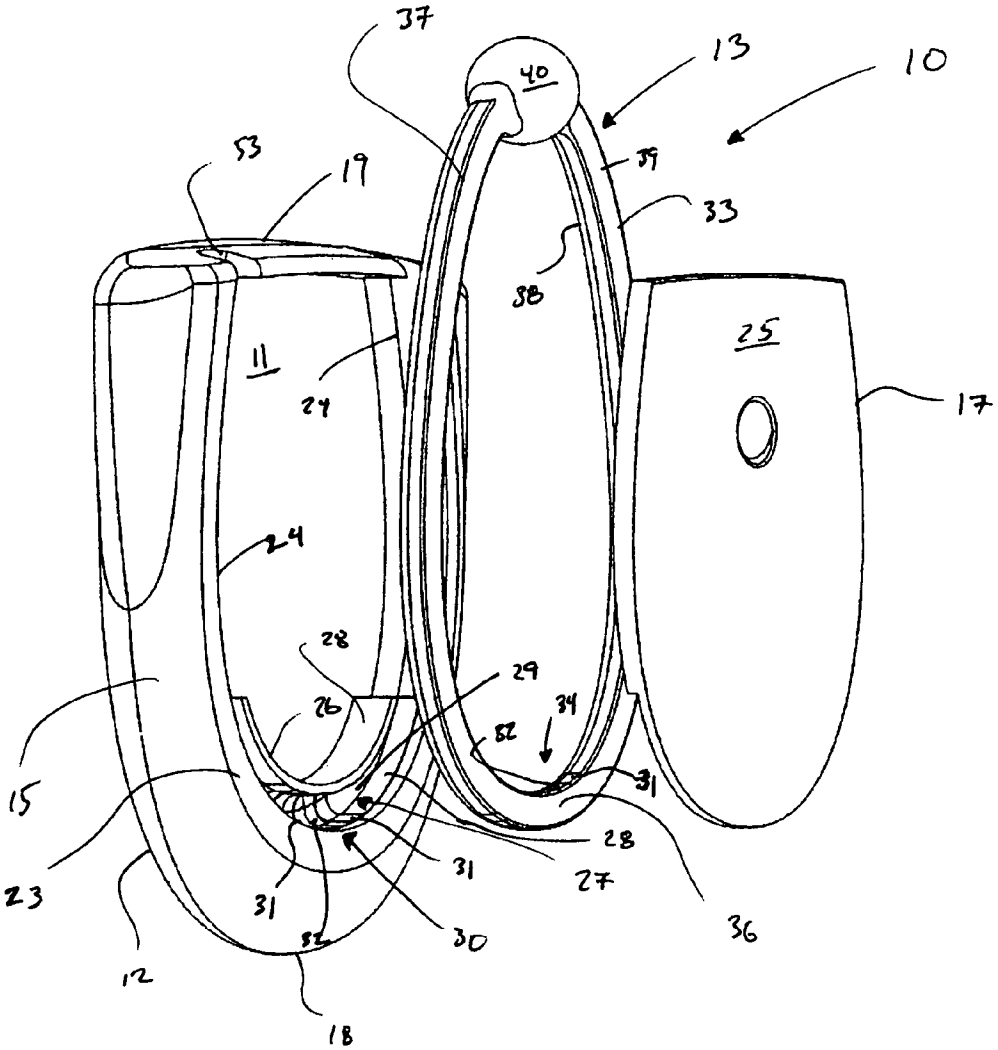
FIG. 3 is an exploded view of the mobile station of FIG. 1.

Referring now to FIG. 3, wherein the battery cover 17 is separated from the main body 15 of the housing 12, it can be seen that the housing includes a channel wall structure 26 defining a channel 27. In particular, the channel wall structure 26 has a pair of opposing side walls 28 that extend upwards from a bottom wall 29. The channel 27 defined by the walls 28, 29 has an arcuate shape that extends along the bottom trough of the U-shape of the inner edge 24 of the second face 23. Extension of the side walls 28 upwards is to a height just short of the second face 23 by an amount approximately equal to a thickness of the battery cover 17 so that the battery cover will be supported in the above-described flush arrangement with the second face. In addition, closure of the battery cover results in the channel 27 being closed off, thereby facilitating retention of the handle 13, as will be described in more detail below. A pair of notches 53 are defined by the main housing body 15 at the flat top edge 19 to allow the handle 13 to pass therethrough. Closure of the battery cover 17 is also facilitated by a recess 54 which provides clearance for the first portion 36 and side walls 28 of the channel wall structure 26.

The housing may also include an electrical or optical conducting contact 30 that is connected in electrical or optical communication with the battery (not shown) or other power or processing source of the mobile station 10. The conducting contact 30 includes a plurality of spaced contact portions 31 that are constructed of some type of conductive material, such as copper sheet, molded or shaped to conform with the inner surfaces of the channel wall structure 26. In particular, each of the contact portions 31 extends in a strip along adjacent inner surfaces of the walls 28, 29 and are spaced from each other by similarly-shaped nonconductive portions 32. In this manner, the alternating conductive and nonconductive portions, 31 and 32 respectively, form a "zebra" type conducting contact. The term "conducting" as used herein denotes the ability to transmit power and data signals using optical, electrical or other types of power and communications standards.

Advantageously, the zebra-type conducting contact 30 of the illustrated embodiment provides a robust electrical or optical connection with the handle 13 (as will be described in more detail below). However, it should be recognized that various configurations of conducting contact 30 could be employed as long as some type of electrical, optical, or other conducting connection is established. Materials used for the conducting contact can include conducting metals, polymers, composites, etc., as long as conducting contact can be made with a conducting contact of the handle 13. Other geometries and positions could also be used for the conducting material (s) so as to facilitate engagement with the conducting contact of the handle. For instance, the entire channel wall structure 26 could be coated with a copper material.

The housing 12, including its main body 15 and covers 22, 25 are preferably constructed of a relatively hard plastic material that is both light weight and protective. However, the housing is not necessarily limited to a collection of covers or any particular shape, material or configuration as long as the remaining components of the mobile station 10 are held together in a manner sufficient to operate and some portion of the housing 12 defines one or more channels. The term "channel" as used herein should be construed broadly and denotes any slot, groove or other opening, or plurality of openings, defined by one or more surfaces so as to be capable of receiving, and at least partially retaining, one or more portions of the handle 13.

Figure 4:
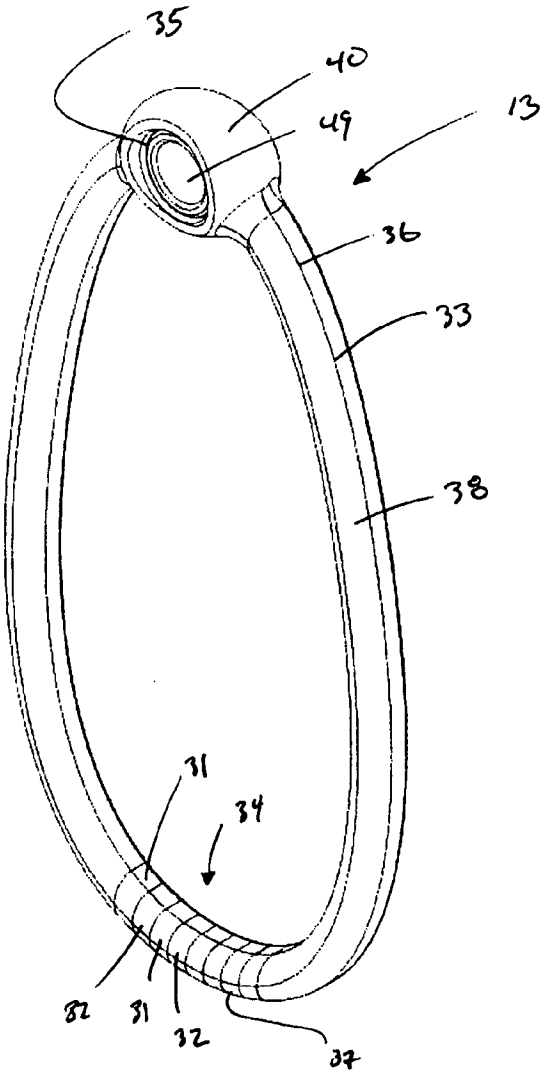
FIG. 4 is a perspective view of the handle of FIG. 1.
Figure 5:
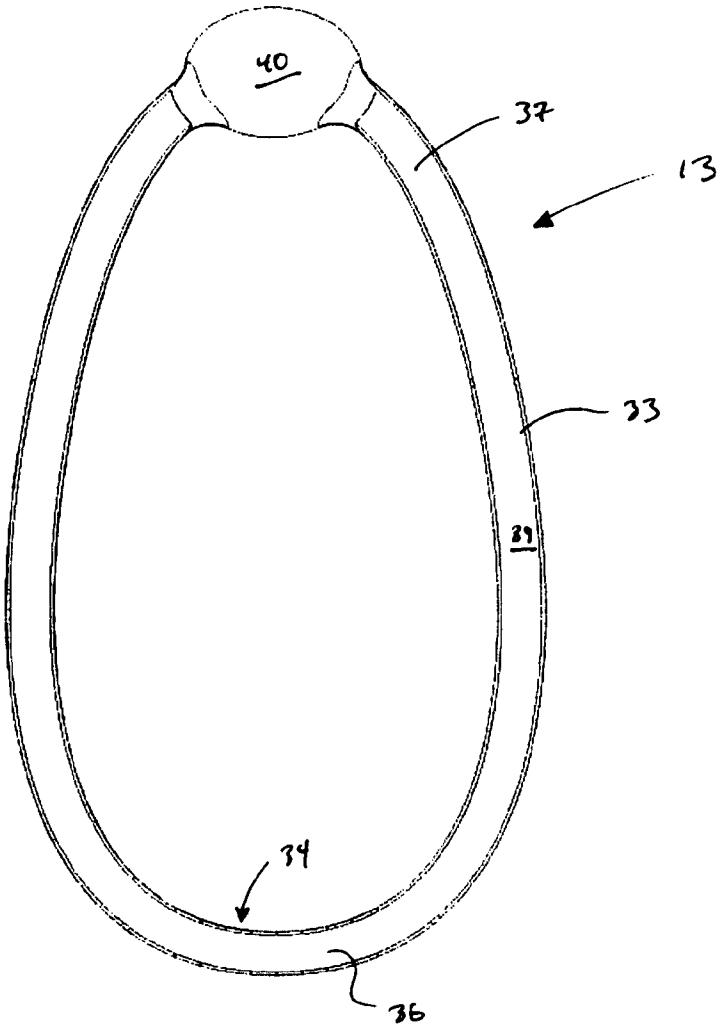
FIG. 5 is a rear elevation view of the handle of FIG. 1.

Referring now to FIGS. 4 and 5, the handle 13 includes a continuous loop of material 33. Generally, a first length portion 36 of the continuous loop 33 of the handle 13 is sized and shaped to fit within the channel 27 of the housing 12 so that a second portion 37 extends outwards from the housing and can support the housing. The second length portion is spaced from the housing to allow the handle 13 to be gripped by a user, or for the mobile station to be otherwise suspended from the handle. The term "continuous loop" refers to the unbroken, closed circuit through which the handle as a whole extends. In the illustrated embodiment, the continuous loop of material 33 has a rounded, elliptical shape. However, this overall size and shape can be varied depending upon such factors as the desired size of the second length portion 37, which could be enlarged to facilitate use, for instance, as a necklace. In another example, the second length portion could include a straight and thick sub-portion at its top end to facilitate easy gripping with a hand.

Figure 6:
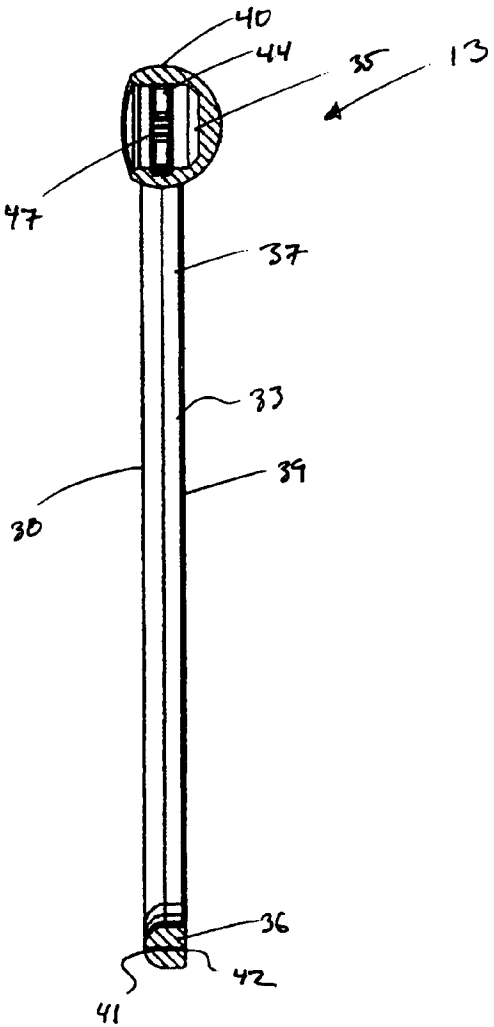
FIG. 6 is a cross-sectional view of the handle of FIG. 1.

The continuous loop of material 33 of the illustrated embodiment generally has a cross-section that has one rounded surface 38 that extends between the edges of an opposite, flat surface 39, as shown in FIG. 6. In the illustrated embodiment, this same cross-section is constant along most of the continuous loop of material 33 with the exception of an optional bulbous portion 40 sized to hold a collet 35, as will be explained in more detail below. The rounded surface 38 of the cross-section at the first length portion 36 facilitates its insertion into the channel 27 between the side walls 28. The opposite flat surface 39 is then positioned flush with the top edges of the side walls 28, allowing snug attachment of the overlying battery cover 17.

Although the illustrated cross-section has several advantages, other cross-sectional shapes could be employed for the continuous loop of material 33. For instance, square, elliptical or circular cross-sectional shapes could be used for the first length portion 36, especially when these shapes match the cross-section of the channel 27 so as to promote a snug fit. In another example, the cross-section may vary along the length of the continuous loop of material 33 such as between the first and second length portions 36, 37 or even within the portions.

The first length portion 36 of the continuous loop of material 33 is preferably constructed of a material that has resiliently compressible properties, such as an elastomeric polymer or rubber material. The second length portion 37 may also be constructed of a deformable material so that the entire continuous loop of material 33 is flexible and deformable. Such properties facilitate insertion and retention of the first length portion 36 of the continuous loop of material 33 in the channel 27 of the housing 12. In particular, on the way into the channel 27, such as under finger pressure, the first length portion 36 deforms to slide between the side walls 28 until making contact with the bottom wall 29 of the channel wall structure 26. The resilient nature of the material spring-biases the first length portion 36 outwards against the channel wall structure 26 to retain the first length portion within the channel 27. Alternatively, or in addition to the use of resiliently compressible properties, the opposing side walls 28 may also be biased inwards against the first length portion 36. It should be noted that resilient compressibility of the second length portion 37 is less important because it does not extend within the channel 27 making it more amenable to being constructed of a larger range of materials.

Figure 7:
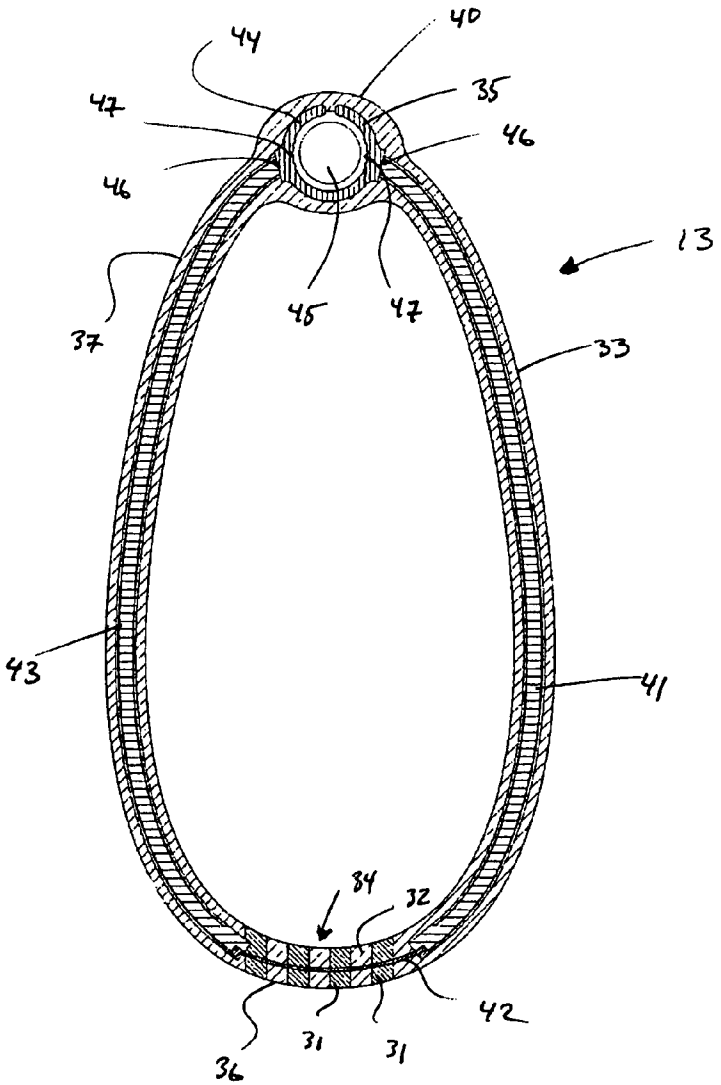
FIG. 7 is another cross-sectional view of the handle of FIG. 1.

The handle 13 can also include optional electrical or optical components, such as the conducting contact 34, the collet 35 and a conducting element 41, as shown by the cross-sectional view in FIG. 7. The conducting contact 34 of the handle 13 of the illustrated embodiment includes contact portions 31 that are constructed of optical, electrical or other conducting material spaced apart by nonconductive portions 32 to form a zebra-type contact with spacing similar to the conducting contact 30 of the housing 12.

In this manner, the contact portions 31 of the two contacts 30, 34 can overlie each other when the first length portion 36 is positioned in the channel 27, thereby ensuring robust conductance between the handle 13 and other optical and electronic components of the mobile station 10. Although the illustrated zebra-type contact 34 is preferred, other configurations of conducting materials can be used, such as wherein the entire first length portion 36 is a transparent, flexible, optically conducting material.

Referring again to FIG. 7, the conducting element 41 includes a first portion, corresponding to the first length portion 36 of the continuous loop of material 33, having a flexible printed circuit 42. The flexible printed circuit extends through the contact 34 and connects at its ends to a second, primary conducting portion 43 which generally corresponds to the second length portion 37 of the continuous loop of material 33. In turn, the primary conducting portion extends into contact with the collet 35 to facilitate the operation of various optical and/or electronic ("optical/electronic") devices, as will be described in more detail below. It should be noted that the conducting element 41 may be have a range of materials, shapes and configurations, such as being constructed of a single conducting material without separate portions, e.g., a continuous line of fiber optic cable or copper cable, as long as it is capable of establishing power or data communication between one or more of the optical/electronic devices and the contacts 30, 34. Preferably, however, the conducting element 41 is constructed of a flexible material so that the overall continuous loop of material 33 is flexible.

Another optical or electrical component of the handle 13 is the collet 35 which serves as a type of connecting element that facilitates interchangeable connection of various devices to the conducting element 41 of the handle. The collet 35 in the illustrated embodiment includes a cylindrical spring 45 having a pair of arms that extend around towards each other to define a central opening 45 into which it is possible to mount various devices. Ends of the conducting element 41 are in connection with laterally positioned mounts 46 of the collet 35 so as to establish communication with the collet and any devices inserted therein. The collet 35 may also include "exposed in mold" transceivers (optical or electrical) that facilitate transmission of signals through the collet between the conducting element 41 and the devices.

Figure 8:
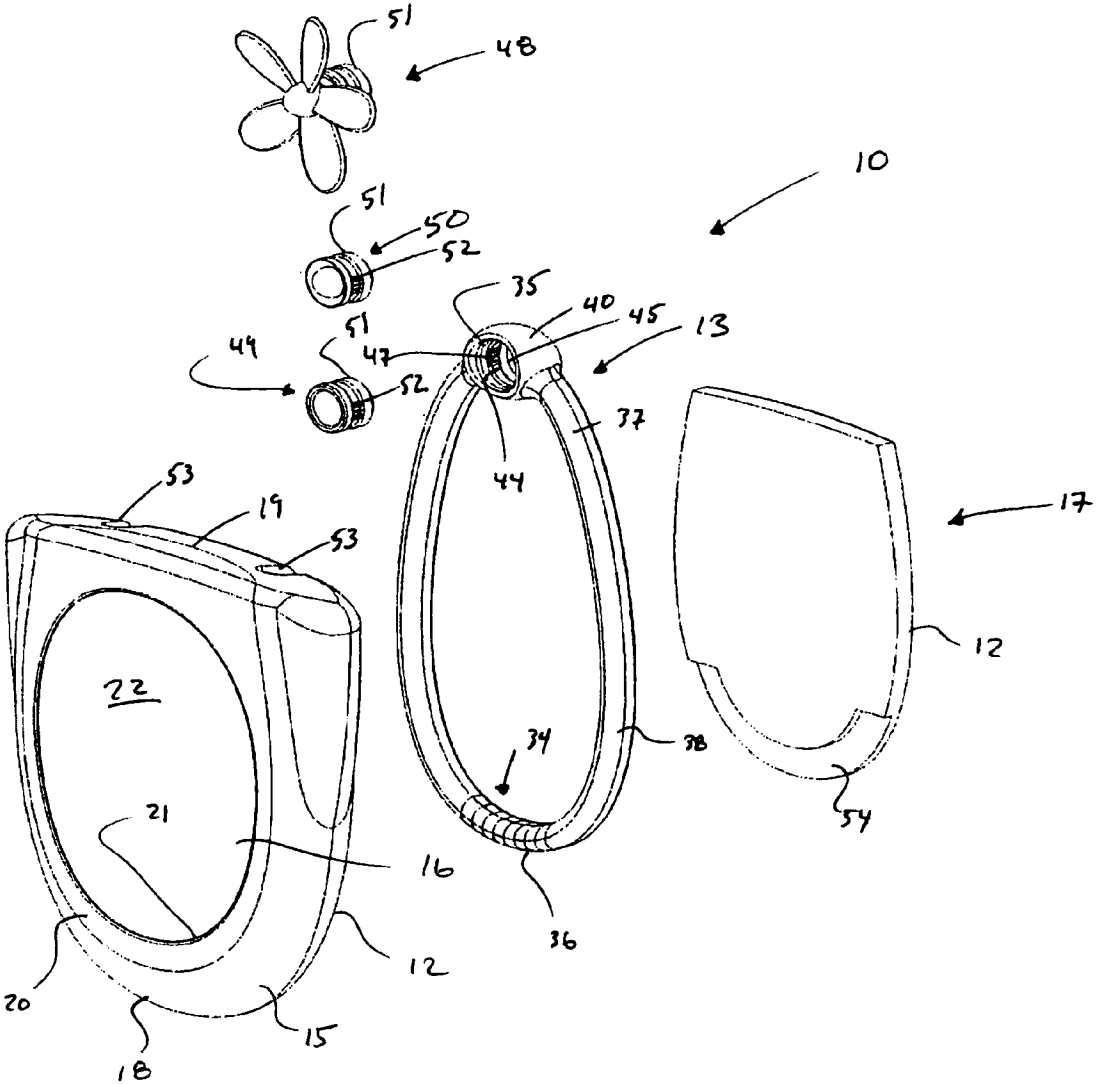
FIG. 8 is another exploded view of the mobile station and handle of FIG. 1, including multiple optical/electronic devices of other embodiments of the present invention for connection to the handle.

As mentioned above, various optical/electronic devices may be employed with the handle 13 wherein the handle serves as a power or communications connection between the devices and the rest of the mobile station 10. Examples of these devices include a noisemaker or fan 48, a camera 49 and a light 50, as shown in FIG. 8. Other examples of the devices include antenna, charging contacts, scent-emitters, bubble blowers and other polysensorial effects.

Although one or more of the optical/electronic devices may be integrated with the rest of the handle 13, the devices are preferably interchangeably mountable in some type of connecting element, such as the collet 35 of the illustrated embodiment. Other types of connecting elements could be used, however, for interchangeability, such as various plugs, spring-biased receptacles or clips. Interchangeability using the collet 35 is facilitated by each of the devices having a similarly shaped, cylindrical male connector end 51 that is slightly oversized with respect to the resting diameter of the collet central opening 45 so as to bias the arms of the cylindrical spring 44 outwards upon insertion. This bias serves to retain the inserted optical/electronic device while still allowing removal and replacement with other devices. Each of the illustrated devices also includes its own contact rim 52 that overlies the transceivers 47, or otherwise makes contact with, conducting aspects of the collet 35 upon insertion therein.

During installation, the handle 13 is attached to the housing 12 of the mobile station 10 by first opening the battery cover 17 to reveal the channel 27 as defined by the channel wall structure 26. The handle 13 is then oriented so that the first length portion 36, and hence the electrical contact 34, of the continuous loop 33 is adjacent the channel 27, with the rounded surface 38 facing the channel wall structure 26. Pressure is applied to the opposite flat surface 39 to urge the first length portion 36 between the side walls 28 until reaching the bottom wall 29. During insertion, the user preferably positions the contact portions 31 of the continuous loop conducting contact 34 in registration with the contact portions of the conducting contact 30 of the housing 12 so as to promote optimal signal and/or power transmission between the handle 13 and the rest of the mobile station 10.

Once the first length portion 36 has been inserted into the channel 27, the cover can be closed into a flush arrangement with the main body 15 of the housing 12 thereby concealing the handle attachment. Before closing, if necessary, the user may also insert a battery to provide power to the mobile station 10 and any devices attached to the handle 13. If not attached, one of the optical/electronic devices can be inserted into the collet 35 by positioning the male connector end 50 adjacent the central opening 45 of the collet. Then, the device is urged into the central opening until the contact rim 51 overlies the transceivers 47. Such attachment results in power and/or data communication being established with the rest of the mobile station 10 through the handle 13.

The mobile station 10 and handle 13 of the present invention have many advantages. For instance, the handle can be used to support the mobile station from a wrist, wall-mounted peg, stand, clothes, etc., and is easily exchangeable with other handles having alternative aesthetic properties for customization of the mobile station 10. When not attached to the mobile station, the different types of handle 13 can be worn as bracelets or jewelry due to their inherent flexibility and the continuous construction of the loop material 33. The functionality of the mobile station 10 is also improved by the use of the various optical/electronic devices, such as the camera 49. Therefore, the interchangeability of the devices also allows functional, as well as the aforementioned aesthetic, customization. The conducting contact 34 which uses the alternating contact portions 31 of conducting elastomeric material allows the entire continuous loop of material 33 to be flexible.

In another embodiment, the handle 13 may also include optical or electronic components useful in a gaming environment. For instance, the handle 13 may include a memory card reader that is connectable to the memory card (or other type of memory storage, such as optical disks or flash memory) which contains information on in-game assets. For instance, the memory card may contain information that is the equivalent of an in-game object (e.g., swords and gold) or attributes (e.g., strength or intelligence of a character), in which case the handles may be collected, traded or used in a promotional give away. As another option, the memory card (or other memory storage medium) may be part of the handle 13.

Some gaming environments in particular benefit from the assets conveyed by the handle and the memory card due to the persistence of assets in the game from session to session. For instance, in card based games (e.g., MAGIC: THE GATHERING) the playing cards have intrinsic value beyond the game due their abilities and rarity. As a result, these cards, similar to the above-described handles capable of defining attributes, are wagered, sold or traded. Other examples of games in which the handle 13 may be used include DUNGEONS AND DRAGONS, WIZARDS OF THE COAST and various Multi-User Dungeon (MUD) games. The MUD games include many players interconnected by a network which would allow the assets conferred by the handle 13 to be conveyed virtually amongst the players, e.g., via a trade or by dropping an asset to be found later by another player. Often, the MUD games are "online" or games accessible via a network. MUD may also refer to Multi-User Domain gaming scheme which contain elements of game play that occur on both the server and on the local client machine.

Online games typically use a client-server architecture wherein a computer program on the server controls the logic and maintains the state of the game in an online arena. The game logic is a set of instructions defining virtual objects in the game, such as castles, swords, etc. Included in the state of the game are characters and their attributes, including skill levels and assets of those characters. The state of the game may be maintained on a database coupled to the server which includes the names, skills, assets, etc., of the characters. The database may include the address location on the server of the code which defines the in-game asset. As a result, when the player loses an asset, the server program deletes the asset from the list and when the player gains an asset it is added to the list. The handle 13 of the present invention may include the code for a virtual asset to be added, or may contain the address of a first player's asset to be transferred to another player's list. In this manner, the handle becomes a tangible embodiment of a virtual asset in the virtual gaming world.

Introduction or transfer of the gaming assets into the virtual environment may be through a connection port in the gaming device, such as via the conducting contact 34 illustrated in the Figures. As another alternative, transfer may be via a non-contact interface such as through electron-inductance driven RFID tags, radio or other wireless communications. In one aspect, the connection may be established with only a single conducting contact using the wearer's body as a ground plane, such as is described in U.S. Pat. No. 6,642,837 to Vigoda, et al., which is hereby incorporated herein by reference. The load, when using the body as a ground plane, is enough to send a sequence of bits, which, in the present case, may be a URL address which contains an in-game asset register number. Such an aspect establishes a personal area network (PAN) with the handle 13 that allows creation and/or upload of the virtual asset.

Figure 9:
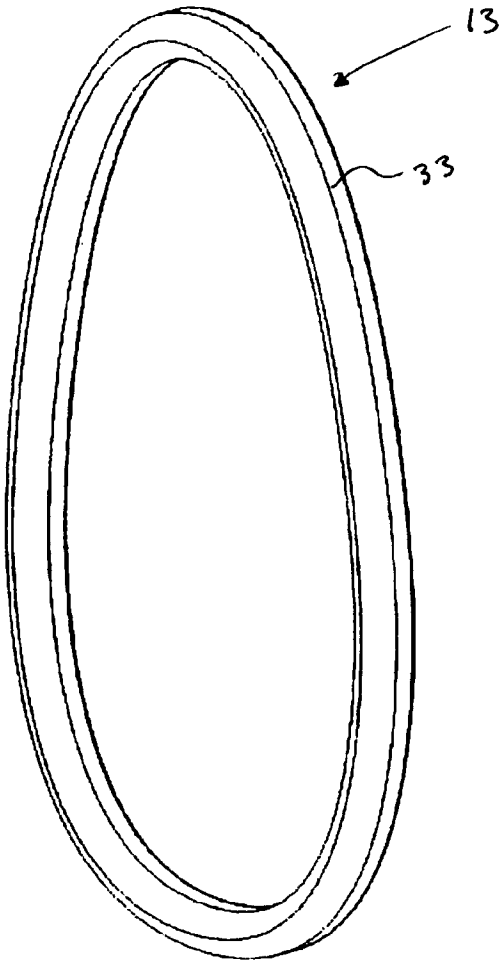
FIG. 9 is a perspective view of a handle of another embodiment of the present invention.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. For instance, another embodiment of the present invention could include a handle 13 does not have optical/electronic components, as shown in FIG. 9. In still another aspect, the handle could act as a high-gain antenna for longer and more reliable network connections, such as in areas with a weaker signal. Although specific terms are employed herein, they are used in a generic and descriptive sense only and not for purposes of limitation.

That which is claimed:

1. A handle for connection to a mobile station, said handle comprising:

a continuous loop of resiliently compressible material having a first length portion extending through the housing, said first length portion being engaged within the housing so that a second length portion of the continuous loop extends out of the housing and is capable of supporting the housing, said continuous loop comprising a communications element extending therethrough; and a connecting element carried by said continuous loop and in communication with said communications element;

wherein the first length portion is configured to be press fit into a channel defined by said housing and includes at least one conducting contact positioned to overlie a conducting contact of the mobile station positioned within the channel defined by the housing.

2. A handle of claim 1, wherein the communications element comprises a conducting element extending along the loop of compressible material and in electrical communication with the conducting contact of the first length portion.

3. A handle of claim 2, wherein the conducting contact of the first length portion includes a conductive elastomeric material configured to extend between the conducting element and the conducting contact of the mobile station.

4. A handle of claim 3, wherein the conductive elastomeric material forms several spaced contact portions that alternate with nonconductive elastomeric material portions of the first length portion.

5. A handle of claim 2, wherein the conducting element includes a printed circuit.

6. A handle of claim 2, further comprising a device engaged by said conducting element and supported by the continuous loop so as to be coupled in communication with the conducting element.

7. A handle of claim 6, wherein the connecting element is a spring-biased collet.

8. A handle of claim 6, wherein the device is one of a light, a fan, a noise generator, a camera and a memory device defining virtual assets.

9. A mobile station comprising:

a telecommunications assembly capable of receiving and generating wireless telecommunications signals;

a power source capable of supplying power to the telecommunications assembly;

a housing containing at least a portion of the telecommunications assembly; and a continuous loop of resiliently compressible material having a first length portion extending through the housing, said first length portion being engaged within the housing so that a second length portion of the continuous loop extends out of the housing and is capable of supporting the housing, said continuous loop comprising a communications element extending therethrough for permitting an element within said housing to communicate external to said housing;

wherein the first length portion is configured to be press fit into a channel defined by said housing and includes at least one contact positioned to overlie a contact positioned within the channel, said contact positioned within the channel being connected to the power source.

10. A mobile station of claim 9, wherein the communications element comprises a conducting element extending along the loop of compressible material and in communication with the contact of the first length portion.

11. A mobile station of claim 10, wherein the contact of the first length portion includes a conductive elastomeric material configured to extend between the conducting element and the contact of the mobile station.

12. A mobile station of claim 11, wherein the conductive elastomeric material forms several spaced contact portions that alternate with nonconductive elastomeric material portions of the first length portion.

13. A mobile station of claim 10, wherein the conducting element includes a printed circuit.

14. A mobile station of claim 10, further comprising a device supported by the continuous loop and coupled in communication with the conducting element.

15. A mobile station of claim 14, further comprising a connecting element sized to receive the device and capable of establishing communication between the conducting element and the device.

16. A mobile station of claim 15, wherein the connecting element is a spring-biased collet.

17. A mobile station of claim 16, wherein the device is one of a light, a fan, a noise generator, a camera and a memory device defining virtual assets.

18. A mobile station of claim 9, wherein the communications element includes an optical conductive element.

19. A method of attaching a handle to a housing of a mobile station, said method comprising:

opening a cover portion of the housing to reveal a channel defined by the housing;

inserting a first length portion of a continuous loop of material of the handle through the housing and into the channel before replacing the cover portion of the housing;

establishing communication between an element within the housing and a communication element that extends through the continuous loop of material such that the element within the housing can communicate external to the housing; and suspending the housing from a second length portion of the continuous loop of material of the handle which extends out of the housing from ends of the first length of the continuous loop of material.

20. A method of claim 19, wherein inserting the first length portion includes press fitting the length portion into the channel.

21. A method of claim 19, wherein inserting the first length portion includes positioning a conducting contact of the first length portion over a conducting contact of the housing.

22. A method of claimed 21, further comprising connecting a device to the second length portion of the continuous loop of the handle such that the device is place in communication via the communication element with conducting contact of the housing.

23. A method of claim 22, further comprising connecting a battery to the conducting contact of the housing after inserting the first length portion to provide power to the device.

24. A method of claim 19, including communicating a virtual asset via the communication element extending through the continuous loop of material.

25. A handle for connection to a mobile station, said handle comprising:

a continuous loop of resiliently compressible material having a first length portion extending through the housing, said first length portion being engaged within the housing so that a second length portion of the continuous loop extends out of the housing and is configured to support the housing, said continuous loop comprising a communications element extending therethrough;

a connecting element carried by said continuous loop and in communication with said communications element; and a device engaged by said conducting element and supported by the continuous loop so as to be coupled in communication with the conducting element.

26. A mobile station comprising:

a telecommunications assembly configured to receive and generate wireless telecommunications signals;

a power source configured to supply power to the telecommunications assembly;

a housing containing at least a portion of the telecommunications assembly;

a continuous loop of resiliently compressible material having a first length portion extending through the housing, said first length portion being engaged within the housing so that a second length portion of the continuous loop extends out of the housing and is configured to support the housing, said continuous loop comprising a communications element extending therethrough for permitting an element within said housing to communicate external to said housing; and a device supported by the continuous loop and coupled in communication with the conducting element.

27. A method of attaching a handle to a housing of a mobile station, said method comprising:

inserting a first length portion of a continuous loop of material of the handle through the housing;

establishing communication between an element within the housing and a communication element that extends through the continuous loop of material such that the element within the housing can communicate external to the housing;

suspending the housing from a second length portion of the continuous loop of material of the handle which extends out of the housing from ends of the first length of the continuous loop of material; and coupling a device to the second length portion of the continuous loop of the handle such that the device is placed in communication via the communications element with the conducting contact of the housing.

* * * * *

UNITED STATES PATENT AND TRADEMARK OFFICE

CERTIFICATE OF CORRECTION

PATENT NO. : 7,392,069 B2
APPLICATION NO. : 10/782317
DATED : June 24, 2008
INVENTOR(S) : Gartrell et al.

It is certified that error appears in the above-identified patent and that said Letters Patent is hereby corrected as shown below:

Column 10,

Line 54, “place” should read --placed--;

Line 55, “communication” should read --communications-- and after “with” insert --the--.

Signed and Sealed this

Twenty-third Day of September, 2008

JON W. DUDAS
*Director of the United States Patent and Trademark Office*